US005697822A

United States Patent [19]

Souter

[11] Patent Number: 5,697,822

[45] Date of Patent: Dec. 16, 1997

[54] APPARATUS FOR WALKING UPON WATER

[76] Inventor: Kelly K. Souter, 1740 Afton Cir., Layton, Utah 84041

[21] Appl. No.: 758,894

[22] Filed: Dec. 2, 1996

[51] Int. Cl.[6] ..... B63B 35/83

[52] U.S. Cl. ..... 441/76

[58] Field of Search ..... 441/65, 76, 77

[56] References Cited

U.S. PATENT DOCUMENTS

| | | | |
|---|---|---|---|
| 1,533,023 | 4/1925 | Meredith | 441/77 |
| 4,034,430 | 7/1977 | Joyce | 441/77 |
| 4,952,184 | 8/1990 | Graziano | 441/77 |
| 5,080,621 | 1/1992 | Nayes | 441/77 |

FOREIGN PATENT DOCUMENTS

| | | | |
|---|---|---|---|
| 736381 | 6/1966 | Canada | 441/77 |
| 3423422 | 1/1986 | Germany | 441/76 |

*Primary Examiner*—Jesus D. Sotelo
*Attorney, Agent, or Firm*—John E. Schone

[57] ABSTRACT

A water walking apparatus has a pair of buoyant platforms with a pair of sidewalls attached to the top surface of each of the buoyant platforms. Removable, inflatable buoyant pontoons are secured to the buoyant platforms through flexible sleeves secured to the sidewalls. The pontoons provide adjustable degrees of buoyancy to allow the user to walk on water. The pontoons have footwells into which the user inserts his foot, resting the foot on the buoyant platform and the foot is secured in place by the addition of air pressure to the pontoon. The buoyant platform has paddles mounted on its bottom surface which rotate rearwardly when the user moves the apparatus forward, thus reducing resistance to forward movement. The paddles rotate forward against a specially structured stop whenever there is any backward or slipping motion of the apparatus thus resisting any backward movement of the apparatus.

7 Claims, 2 Drawing Sheets

APPARATUS FOR WALKING UPON WATER

BACKGROUND OF THE INVENTION

This invention relates to an apparatus for allowing a person to walk on water. More specifically the invention provides for a pair of buoyant pontoons which can be secured to a persons foot and which permit a walking motion on lakes, rivers or other bodies of water. Many types of devices have been proposed in the past which would permit a person to walk on a body of water, but in order to provide sufficient buoyant support for the user, these devices are frequently large and difficult to maneuver. As a result it is cumbersome and difficult to transport them and their use while walking on water can also be cumbersome. The typical water walking device is also fabricated from some type of buoyant material that requires the device to be increased in size if additional buoyancy is to be obtained.

U.S. Pat. No. 4,034,430 is an example of such a water walking device. The pontoons in this invention are fabricated from Styrofoam or other similar buoyant materials and the device is also fitted with transverse stabilizers to maintain a fixed relationship between the individual pontoons. The pontoons slide along the transverse stabilizers to maintain their relative positions but the overall result is a cumbersome device. Furthermore, since the pontoons are fabricated of a solid material the opening for receipt of the user's foot is of a fixed dimension and is therefore not adjustable to adapt to the user's foot.

U.S. Pat. No. 4,952,184 teaches a single piece pontoon also manufactured from a buoyant material such as form rubber or styrofoam. The user's foot is attached to the top of this device with a foot piece that locks the user's foot to the pontoon. This device also includes rotatable paddles attached to the bottom surface of the pontoon which are allowed to rotate horizontally against the bottom surface of the pontoon.

U.S. Pat. No. 5,080,621 describes a third type of water walking device. This device is manufactured from polyurethane foam or other similar material. it has means for attaching the user's foot in place in the pontoon footwell which includes the use of hook and loop tape or a resilient spring like u-shaped rear ankle support.

SUMMARY OF THE INVENTION

The present invention utilizes a number of new approaches to solve the problems that exist in water walking devices. Rather than increasing the size of the buoyant pontoon in order to accommodate larger users, the present invention utilizes an inflatable pontoon which can be inflated as necessary to accommodate the size and weight of the user. According to the present invention, the platform upon which the inflatable pontoon rests is also buoyant and thus part of the buoyancy requirement to accommodate an individual user is provided by the platform itself.

It is also an advantage of the present invention that each pontoon has a footwell into which the user inserts his foot allowing him to stand on the buoyant platform that rests beneath the pontoon. Rather than having to utilize some type of attaching device to secure the foot of the user to the water walking device, the user, according to the present invention secures his foot to the pontoon and to the buoyant platform by increasing the air pressure in the pontoon. Increasing the air pressure in the pontoon has the effect of increasing the pressure upon the ankle area of the user and, accordingly, the user can secure his foot to the pontoon to any degree that is comfortable, yet still allow the user to remove his foot from the pontoon when such removal is desirable or necessary.

Since the pontoon is inflatable with air, it is an additional advantage of the invention that it is light and easily transportable. The pontoon is attached to the buoyant platform when the apparatus is ready to be put into use, but the pontoon and buoyant platform can be detached for transport further increasing the advantage of the present invention for purposes of transportation. When deflated, the pontoon can be rolled up thus decreasing both the size and weight of the apparatus for transport.

It is a further advantage of the present invention that the pontoon can be attached to the buoyant platform through the use of a flexible sleeve attached to the top surface of the buoyant platform. Increasing the air pressure in the pontoons, therefore, permits the pontoon to be secured inside the sleeve to any degree that might be desirable. The sleeve itself, has an orifice which aligns with the footwell in the pontoon providing the advantage of assuring the proper alignment of the pontoon within the sleeve and further restricting any lateral rotating movement of the pontoon.

It is another advantage of the invention that the buoyant platform includes rotatable paddles mounted on the bottom surface of the buoyant platform. These paddles swing in a rearward direction whenever the water walking apparatus moves forward through the efforts of the user taking a step or sliding the pontoon in a forward direction. By the action of the paddles in swinging in a backward direction, the resistance of the apparatus to forward motion is reduced. Additionally, the paddles rotate in a forward direction to resist the rearward movement of the apparatus. It is an advantage of the present invention that each paddle is fitted with triangularly shaped uprights on the top side of the paddle in order that the paddle does not reach a completely horizontal position when forced rearwardly. As a result, increasing pressure is immediately exerted upon the paddle when the apparatus is urged in a rearward direction. Without such uprights secured to the top side of the paddle, the paddle could remain in a horizontal position even when the apparatus is urged in a rearward direction and therefore the necessary resistance to rearward motion would not be achieved.

It is yet another advantage of the invention that the paddles are attached to stops that are in mm mounted on the bottom surface of the buoyant platform. These stops incorporate a downwardly projecting finger that serves to prevent the rotation of the paddle beyond the finger itself. The stop, together with the downwardly projecting finger, supports the resistance of the paddle to any rearward motion of the apparatus. It is another advantage of this invention, that the paddle maybe attached to the stop through a prong projecting upwardly through a slot in the paddle thus allowing the paddle to rotate rearwardly yet at the same time securing the paddle to the stop.

These and other advantages of the present invention will become apparent from the subsequent detailed description of the preferred embodiment and the appended claims when read in conjunction the accompanying drawings which are described below.

DETAILED DESCRIPTION OF THE INVENTION AND PREFERRED EMBODIMENT

Figure 1:
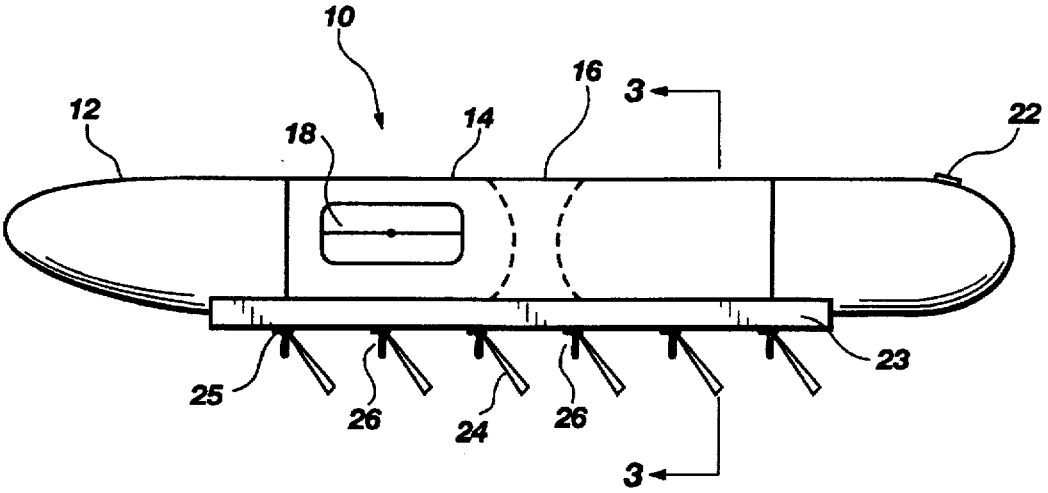
FIG. 1 is a side elevational view of the apparatus for walking on water of the present invention.
Figure 2:
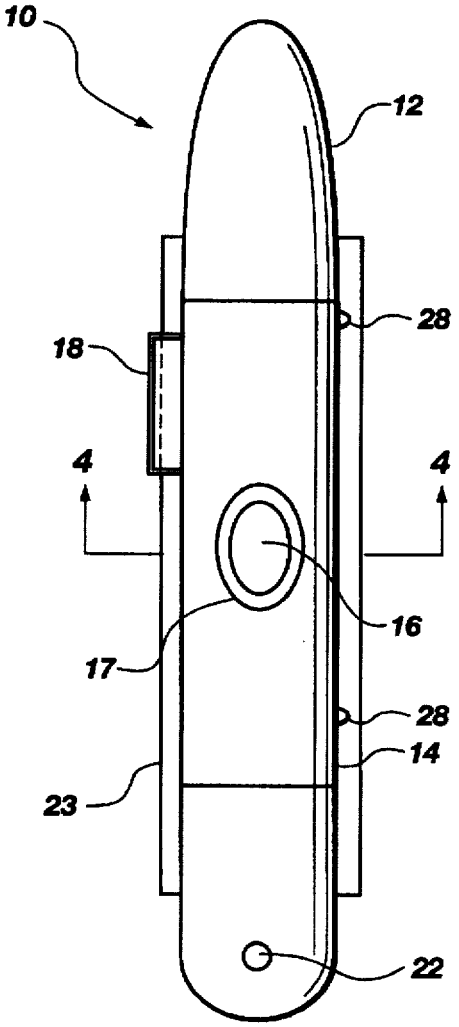
FIG. 2 is a top plan view of the apparatus for walking on water of the present invention.

An apparatus for walking on water is shown at number 10 of FIG. 1 and 2. The apparatus is generally comprised of two main sections: a pair of buoyant, inflatable pontoons 12 together with attendant features to be described later, and a pair of buoyant platforms 20 together with their features, all of which will be described later in more detail. In FIGS. 1 and 2, reference 12 is an elongated, inflatable pontoon. The apparatus is comprised of first and second elongated, inflatable pontoon 12, with each of such pontoons 12 having a top surface and a bottom surface. Pontoon 12 can be manufactured from any expandable material capable of holding pressurized air, including rubber, however the preferred embodiment would be a vinyl plastic material.

As is evident in FIG. 1 and FIG. 2, pontoon 12 is of an elongated shape and is typically longer than buoyant platform 20 on which it rests and to which it is secured as described later in more detail. Pontoon 12 is generally about six feet in length, however it may be longer if necessary, to accommodate users of unusually large size.

Referring again to FIG. 1 and FIG. 2, footwell 16 is an opening proceeding from the top surface of pontoon 12 through the bottom surface of pontoon 12 in a fashion similar to the hole in a donut. Footwell 16 allows the foot of a user of apparatus 10 to step completely through pontoon 12 and rest on buoyant platform 20. By adding additional pressurized air into pontoon 12 or by releasing air, footwell 16 can be tightened or loosened around the foot and ankle of the user. This allows the user to maintain his foot comfortably in footwell 16 so that the user can walk with apparatus 10 securely attached to his foot and at the same time maintain his ability to withdraw his foot when desired or when necessary. As pontoon 12 is fabricated from an elastic material, the user's foot can be withdrawn without having to reduce air pressure since removing the user's foot merely deforms pontoon 12. In the preferred embodiment, footwell 16 would be located close to the center of pontoon 12. Air valve 22 is used for the purpose of admitting air into pontoon 12 and for releasing air as well, when desired. Air valve 22 provides a means for admiring pressurized air into pontoon 12 from any convenient source of pressurized air including such commonly available sources as automobile tire air pumps or by the user blowing air into pontoon 12. Air valve 22 may be located at any point on pontoon 12, however in the preferred embodiment it is located at the rear end and top surface of pontoon 12 to allow for ease of air inflation when pontoon 12 is in position to move forward into the water.

The use and application of sleeve 14 will now be explained. As is evident from FIGS. 1 and 2 and particularly from cross-sectional view FIG. 3, sleeve 14 is adapted for receiving and embracing pontoon 12 due to the fact that it has an opening at each end through which pontoon 12 may be fitted. This is accomplished by sliding uninflated pontoon 12 into sleeve 14 and then inflating pontoon 12 as necessary through air valve 22 in order that pontoon 12 is securely restrained from moving. In the preferred embodiment, sleeve 14 is manufactured from vinyl plastic but other materials exhibiting some elastic properties, including rubber and reinforced fabric can be utilized. In an alternate version (not shown) sleeve 14 may be manufactured with a sock like appearance having only a single rear opening through which pontoon 12 may be admitted.

Orifice 17 is a hole located through the top and center of sleeve 14. Orifice 17 is approximately the size of a person's foot and is intended to align over and above footwell 16. Through the alignment of orifice 17 and footwell 16, pontoon 12 is properly situated and oriented on buoyant platform 20. As will be more fully described below, sleeve 14 is attached to the top surface of buoyant platform 20 so that when pontoon 12 is inflated and held in place by sleeve 14 it will not move in relation to platform 20.

Figure 3:
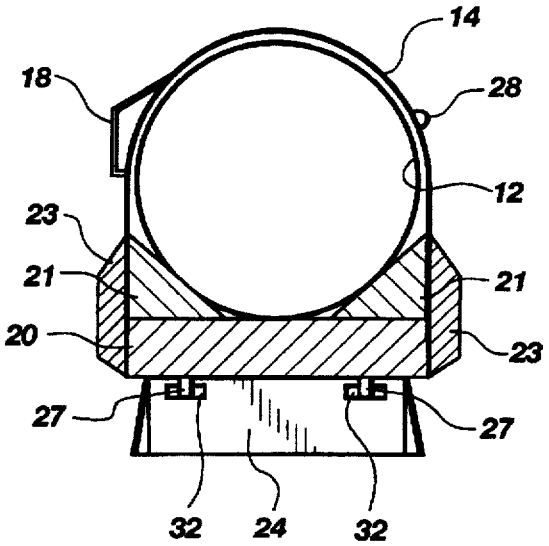
FIG. 3 is a cross-sectional view of FIG. 1 along line 3—3 of FIG. 1.

Turning now to FIG. 1 and FIG. 3, buoyant platform 20 will be explained. In the preferred embodiment, buoyant platform 20 is composed of plywood, however other buoyant materials such as the material sold under the trademark name of Styrofoam can be utilized. Buoyant platform 20 has a top surface and a bottom surface and is shorter than pontoon 12 being, in the preferred embodiment, approximately four feet long, eight inches in diameter and one half inch in thickness. For the purpose of detachably securing pontoon 12 to buoyant platform 20, sleeve 14 may be securely attached to the top surface of buoyant platform 20 through any of the commonly available fastening means including stapling, nailing or the use of adhesives. Pontoon 12 thereby becomes attached to buoyant platform 20 when pontoon 12 is inflated and held in place by sleeve 14 and is also easily detached by releasing air from through air valve 22. In the preferred embodiment, buoyant platform 20 is further modified by the addition of sidewalls 21 and retainer 23. Sidewalls 21 and retainer 23, in a fashion similar to buoyant platform 20, are composed of buoyant materials such a plywood or Styrofoam. Sidewalls 21 are mounted to the top surface of buoyant platform 20 by any of the commonly available fastening means including screws, nails, or adhesives. As is clearly evident in FIG. 3, in the preferred embodiment sidewalls 21 are located along the edges of the top surface of buoyant platform 20. Sidewalls 21 as well as retainer 23 proceed the entire length of buoyant platform 20 parallel to the center line of pontoon 12. Sidewalls 21, in the preferred embodiment are formed as a part of buoyant platform 20 and are therefore, not detachable from buoyant platform 20. Sleeve 14 may be attached to the interior surfaces of sidewalls 21 but in the preferred embodiment, sleeve 14 is attached by nails, staples, adhesive or other commonly available fastening methods to the exterior surface of sidewalls 21 Retainer 23 is then placed over sleeve 14 and attached, through sleeve 14, directly to sidewalls 21 by nails, screws or staples so as to firmly secure sleeve 14 in place. Through the addition of sidewalls 21, the sideways or lateral rotation of pontoon 12 is restricted.

Figure 4:
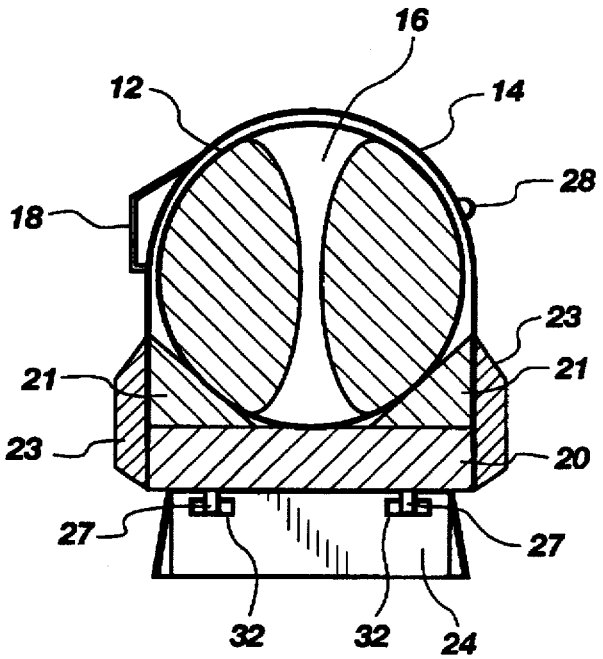
FIG. 4 is a cross-sectional view of FIG. 2 along line 4—4 of FIG. 2.
Figure 6:
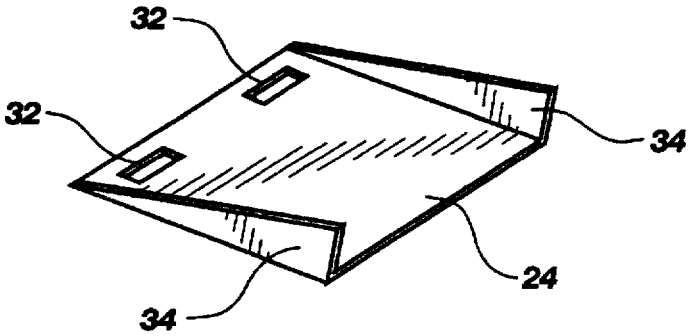
FIG. 6 is a perspective view of a paddle.

FIG. 4 is another cross-sectional view of apparatus 10 taken through a line running through footwell 16 and orifice 17. It can be clearly seen in FIG. 4 how footwell 16 can be enlarged or restricted by the adjustment of the air pressure in pontoon 12. The addition of further air pressure in pontoon 12, for example, constricts footwell 16 and adds additional pressure upon the ankle and foot of the user to more securely hold the user's foot in place. Reducing air pressure in pontoon 12 has the opposite effect of releasing pressure on the ankle and foot of the user. FIGS. 3 and 4 also show the attachment of paddle 24 beneath buoyant platform 20. A perspective view of paddle 24 is provided in FIG. 6. Paddle 24 may be fabricated from plastic but light metals such as aluminum may be used and wood may also be used. In the preferred embodiment, paddle 24 is the same width as buoyant platform 24 and is seven and one half inches in length measured along a side of paddle 24 parallel to the centerline of pontoon 12.

Attached to the top side of paddle 24 are a pair of upwardly projecting, triangularly shaped uprights 34, which are, in the preferred embodiment, composed of the same material as paddle 24 itself. The triangularly shaped uprights 34 are narrowest at the end of paddle 24 that is suspended beneath the bottom surface of buoyant platform 20 as will be described in more detail later. Uprights 34 are attached parallel to the center line of pontoon 12 to the top side of paddles 24 through the use of adhesives when paddle 24 and uprights 34 are fabricated from plastic or wood but they may be attached by any of the well known fastening means in the event paddle 24 and uprights 34 are fabricated from metal. In the preferred embodiment, uprights 34 are part of a single unit comprising paddle 24 together with upright 34.

Figure 5:
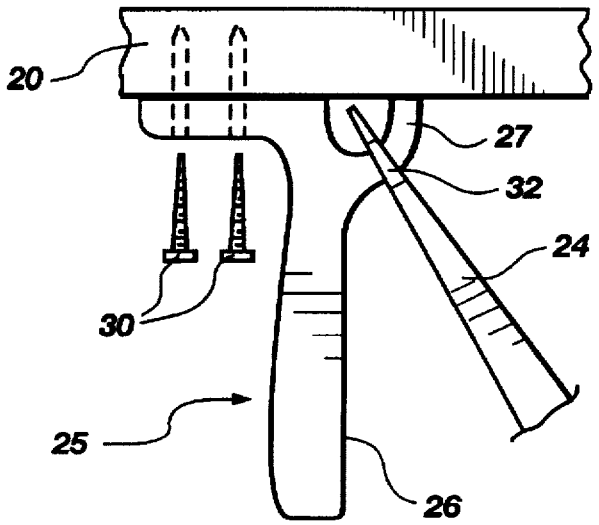
FIG. 5 is an enlarged fragmented side elevational view of a paddle and of a stop.

FIG. 5 is a fragmented side elevational view showing how paddle 24 is attached to buoyant platform 20. Stop 25 is the device by which paddle 24 is connected to buoyant platform 20. Stop 25 is formed from any rigid material such as wood or metal but in the preferred embodiment it is plastic. Finger 26, which is an integral part of stop 25, projects perpendicularly downward from the bottom surface of buoyant platform 20 and provides the stopping surface which prevents paddle 24 from rotating further than ninety degrees away from the bottom surface of buoyant platform 20. With paddle 24 rotated against finger 26, a maximum amount of force is generated against any rearward motion by buoyant platform 20. Stop 25 is secured to the bottom surface of buoyant platform 20 by any conventional fastening means however in the preferred embodiment stop 25 is attached with two screws which project through buoyant platform 20 and into sidewalls 21. As shown in FIG. 5, prong 27 is attached to stop 25 and projects upwardly against the bottom surface of buoyant platform 20. Prong 27 may be fastened to stop 25 through any conventional fastening means and may also be fabricated as a part of stop 25. By the use of slot 32, which will be described below, paddle 24 is attached to prong 27. Prong 27, as stated above, is fastened to stop 25 and stop 25, in ram, is attached to the bottom surface of buoyant platform 20. As can be seen in FIG. 5, paddle 24 is only loosely attached to stop 25 through the use of slots 32 in paddle 24. Prong 27 projects through slot 32 and holds paddle 24 securely in place. Slot 32 is larger than the diameter of prong 27, and therefore paddle 24 is allowed to slide freely from a position horizontal and parallel to the bottom of buoyant platform 20 to a position perpendicular to buoyant platform 20 at which point paddle 24 is restricted from further movement by finger 26. Since prong 27 projects against the bottom of buoyant platform 20, paddle 24 cannot be detached from prong 27 unless stop 25, itself, is removed from buoyant platform 20.

FIGS. 3–6 shows slot 32 and its intended use. Slot 32 is an opening through paddle 24 near the edge of paddle 24 and at the smallest end of upright 34. Multiple slots 32 can be included in a line on paddle 24 perpendicular to the centerline of pontoon 12. For the preferred embodiment there are two such slots 32. Slot 32 is placed close enough to the edge of paddle 24 to allow unrestrained swinging motion by paddle 24. Any number of prongs 27 may be utilized to attach paddle 24, however in the preferred embodiment two stops 25 with attached prongs 27 would engage two slots 32 in paddle 24.

Referring again to FIG. 1, it can be seen that paddles 24 are evenly spaced along the bottom surface of buoyant platform 20. Paddles 24 are spaced in a manner that allows each paddle 24 to rotate rearwardly against the bottom surface of buoyant platform 20 without interfering with the movement of other paddies 24. In the preferred embodiment there are six such paddles 24. When apparatus 10 is moved forward by a step taken by the user, paddles 24 are rotated rearwardly toward platform 20. Because of uprights 34, however, paddles 24 cannot rotate completely horizontal against the bottom surface of buoyant platform 20 and as a result, a rearwardly facing opening is created by the combination of paddle 24, uprights 34 and the bottom surface of buoyant platform 20. Any rearwardly directed force on apparatus 10 will immediately cause the opening to increase and urge paddle 24 against finger 26.

Storage pouch 18 is shown in FIGS. 1–4. storage pouch 18 is attached to sleeve 14 by any convenient means including lamination or sewing. Storage pouch 18 allows the user of apparatus 10 to carry additional gear with him and at the same time keep his hands free. Commonly carried equipment which could be included in storage pouch 18 would include flashlights, first aid kits, tire pump needles, twine and rope. Storage pouch 18 is easily covered through the use of a top flap which can be opened and closed with a zipper or with fastening methods such as those sold under the trademark name of Velcro.

Apparatus 10 as stated previously consists of first and second pontoons 12, one for each foot of the user. In order to keep pontoons 12 from moving in different directions while in use, each pontoon 12 is fitted with eyelet 28 mounted on sleeve 14. Eyelet 28 is attached to sleeve 14 by lamination or sewing or by any other convenient fastening method. Eyelet 28 can be any type of loop or hook sufficient to allow flexible nylon cord or other similar cord to be tied to it. In the event that one of the pontoons 12 is released from the foot of the user, pontoon 12 will nevertheless be restrained from floating away because of the flexible cord connecting eyelet 28 of each of the pontoons 12, through sleeve 14, which secures and surrounds pontoon 12.

While there is shown and described the: present preferred embodiment of the invention, it is to be distinctly understood that this invention is not limited thereto but may be variously embodied to practice within the scope of the following claims:

I claim:

1. Apparatus for walking on water comprising:

first and second elongated, inflatable pontoons each having a top surface and a bottom surface, and each pontoon having a footwell through the top surface thereof for adjustably securing the foot of a person;

a buoyant platform on which the bottom surface of each of the pontoons rests, said buoyant platform having a top surface and a bottom surface;

a pair of sidewalls securely mounted on the top surface of the buoyant platform parallel to the center line of the pontoon for the purpose of preventing the lateral rotation of the pontoon, each sidewall having an exterior surface;

a flexible sleeve securely attached to the exterior surface of each of the sidewalls for receiving the inflatable pontoon and securely embracing the pontoon when pontoon is in its inflated state, said sleeve having an orifice alignable with the footwell in the pontoon;

a plurality of stops attached to the bottom surface of each of the buoyant platforms, each of the stops having a finger projecting downwardly perpendicular to the bottom surface of the buoyant platform;

a plurality of rearwardly swinging paddles, each having a top side and a bottom side and each rotatably mounted to at least one of the stops so that the paddles are rotatable between the finger of the stop and the bottom surface of the buoyant platform under conditions of forward movement of the apparatus;

a pair of upwardly projecting triangularly shaped uprights secured to the top side of each of the paddles and parallel to the center line of the pontoon, so that a rearwardly facing opening is defined when the paddle is rotated against the bottom surface of the buoyant platform.

2. The apparatus according to claim 1 further comprising a storage pouch attached to the sleeve.

3. The apparatus according to claim 1 further comprising eyelits attached to the sleeve for attaching a flexible connector between the first pontoon and the second pontoon.

4. The apparatus according to claim 1 wherein the sleeve is comprised of a fabric material.

5. The apparatus according to claim 1 further comprising retainers mounted on the exterior surface of the sidewalls.

6. The apparatus according to claim 5 wherein the sleeve is attached to the exterior surface of the sidewalls by the retainers.

7. The apparatus according to claim 1 wherein each of the pontoons further comprises an air valve adapted for receiving pressurized air.

* * * * *